United States Patent [19]

Kephart et al.

[11] Patent Number: 4,806,216

[45] Date of Patent: Feb. 21, 1989

[54] ELECTROCHEMICAL POLISHING OF NOTCHES

[75] Inventors: Alan R. Kephart; Alfred H. Alberts, both of Scotia, N.Y.

[73] Assignee: The United States of America as represented by the United States Department of Energy, Washington, D.C.

[21] Appl. No.: 146,639

[22] Filed: Jan. 21, 1988

[51] Int. Cl.[4] ..... C25F 3/16; C25F 7/00

[52] U.S. Cl. ..... 204/129.5; 204/129.7; 204/129.75; 204/224 M; 204/275; 204/292

[58] Field of Search ..... 204/224 M, 129.55, 271, 204/275, 129.6, 129.7, 129.75, 292

[56] References Cited

U.S. PATENT DOCUMENTS

| | | | |
|---|---|---|---|
| 2,848,410 | 8/1958 | Knuth-Winterfeldt et al. | 204/129.6 X |
| 3,202,598 | 8/1965 | Covington et al. | 204/224 M |
| 3,268,434 | 8/1966 | Weingartner | 204/129.55 X |
| 3,637,468 | 1/1972 | Icxi et al. | 204/271 X |
| 3,793,169 | 2/1974 | Joslin | 204/129.55 |
| 3,816,272 | 6/1974 | Joslin | 204/129.1 |
| 4,125,444 | 11/1978 | Inoue | 204/129.43 |
| 4,431,501 | 2/1984 | Leppanen | 204/224 R |
| 4,612,101 | 9/1986 | Wolter et al. | 204/129.55 X |

*Primary Examiner*—Donald R. Valentine
*Attorney, Agent, or Firm*—William W. Randolph; Judson R. Hightower; Richard E. Constant

[57] ABSTRACT

An apparatus and method are disclosed for the selective electrochemical polishing of a lateral tip of a deep longitudinal notch in a work piece used to test crack initiation properties of materials. A DC power source is connected to the work piece and to an electrode disposed laterally along the distal end of an insulated body which is inserted in the longitudinal notch. The electrode and distal end of the body are disposed along the tip of the notch, but are spaced from the notch so as to provide a lateral passage for an electrolyte. The electrolyte is circulated through the passage so that the electrolyte only contacts the work piece adjacent the passage. Conveniently, the electrolyte is circulated by use of an inlet tube and an outlet tube provided at opposite ends of the passage. These tubes are preferably detachably located adjacent the ends of the passage and suitable seals are provided. A holding device including arms to which the tubes are attached is conveniently used to rapidly and easily locate the test specimen with the passage aligned with the tubes. The electrode is preferably a wire which is located in grooves along the distal end of the insulated body and up one side of the body or a plastic sheath insulated thin metal strip.

9 Claims, 2 Drawing Sheets

ELECTROCHEMICAL POLISHING OF NOTCHES

The U.S. Government may have rights in this invention pursuant to contract DE-AC12-76-SN00052 with the U.S. Department of Energy.

FIELD OF THE INVENTION

The present invention relates generally to the preparation of compact tension test specimens, and more particularly to the electrochemical polishing of the tip of a deep notch provided in such a compact tension test specimen.

BACKGROUND OF THE INVENTION

In order to measure crack initiation properties of materials, test specimens are provided with deep notches having a tip region. Such test specimens are then subjected to tension to measure crack initiation properties such as fatigue, corrosion fatigue, and stress corrosion cracking. However, the machining process used to provide the notch in the test specimen induces residual stresses and disstressed metal in the form of a surface machining affected zone or layer. Such a surface machining affected zone or layer has a variable and confounding effect on any test results involving crack initiation properties of materials.

It is known that the surface affected zone can be removed by an anodic dissolution using electrochemical polishing techniques prior to tensioning of the test specimen. This is accomplished by using a bulk circulating electrolyte and large surface electrodes remote from the notch and tip where it is desired to remove the surface machining affected zone. While such a process does remove some material from the deep notch tip region, it also causes metal removal from all of the exterior test specimen surfaces as well. In addition, such a process does not facilitate a controlled, uniform surface removal from the deep notch tip region. Although a stop-off agent on the exterior specimen surface can be utilized to prevent general surface dissolution, any dissolution of the deep notch tip region still remains irregular due to the remotely placed electrode and the test specimen geometry induced current gradients in the electrolyte.

Conversely, local electrochemical surface processes must avoid non-uniform surface conditioning, such as test metal grain boundary attack or metal surface microcracks. Such conditioning would compromise definition of the crack imitation phase of material behavior.

Various electrochemical machining processes and apparatuses have been disclosed in the prior art. For example, in U.S. Pat. No. 3,793,169 (Joslin), an electochemical machining process for machining small deep holes is disclosed. This machining operation is accomplished using a thin hollow cathode which conducts the electrolyte to the work area through a central bore. The effluent electrolyte flows away from the work area in the annular space created between the surface of the hole being drilled and the hollow cathode. Another electrochemical treatment of small holes is disclosed in U.S. Pat. No. 3,816,272 (Joslin). According to the disclosure of this patent, the recast surface layer of a laser-drilled hole is removed by an electrochemical machining technique which involves the positioning of an electrode in the hole and the flowing of electrolyte through the hole and around the electrode.

An apparatus for electrolytic polishing is disclosed in U.S. Pat. No. 4,431,501 (Leppanen). The disclosed apparatus includes a soft surface supported on an arm with conductive members in the soft surface. The soft surface is an absorbent material containing an electrolyte. In U.S. Pat. No. 4,125,444 (Inoue), an electrochemical polishing method is disclosed which makes use of an electrotool having a hollow handle through which electrolyte is pumped to a specific area to be polished.

SUMMARY OF THE INVENTION

In accordance with the present invention, an apparatus and method for the selective electrochemical polishing of a lateral tip of a deep longitudinal notch in a work piece in provided. A DC power source is connected to the work piece. A body formed of an insulating material is sized to be inserted longitudinally in the notch so that a lateral distal end of the body seals the notch longitudinally and is located adjacent the lateral tip of the notch. In the space between the lateral distal end and the lateral tip, a passage is thus provided. An electrode is disposed laterally along the distal end of the body, and this electrode is connected to the DC power source as well. An electrolyte is then circulated through the passage and the DC power is turned on such that the electrolyte only contacts the work piece adjacent the passage to polish only the area of the lateral tip.

Preferably, the lateral passage includes two ends so that circulation of the electrolyte is accomplished by use of an inlet tube located at one end of the passage and an outlet tube located at the other end of the passage. The inlet tube and outlet tube are detachably located adjacent the ends of the passage. Suitable sealing means are provided at the ends of the inlet tube and outlet tube to prevent the flow of electrolyte anywhere but through the passage.

In a preferred embodiment of the present invention, a first arm having a distal end is provided to which the seal means for the inlet tube is attached. A second arm is also provided having a distal end to which the seal means for the outlet tube is attached. A resilient means is then provided between the first arm and second arm to resiliently urge the distal ends of the first arm and second arm towards one another. This provides a spring type clamp for urging the two sealing means against the opposite ends of the passage so that numerous tests specimens can be quickly and easily inserted and removed in order to polish the lateral tips thereof.

In the preferred embodiment, the electrode is a wire which is disposed in a central groove provided in the distal end of the insulated body. A further portion of the wire is also located in a central groove provided along a longitudinal side of the insulated body. Preferably, the insulated body is made of plastic and the electrode is a nichrome wire. When used on a nickel-chromium alloy test specimen, the electrolyte is preferably sulfuric-nitric acid.

It is an object of the present invention to facilitate the selective anodic dissolution of the surface of a tip of a deep notch in a test specimen to be subjected to stresses to determine the properties of the test materials.

It is also an object of the present invention to perform a controlled, uniform, dissolution of the local notch tip surface of a deep notch in a test specimen to remove the surface machining affected zone or layer.

It is another object of the present invention to select the electrolyte, electrolyte flow rate, and current density to avoid preferential attack of the test metal grain boundaries leading to accelerated corrosion fatigue or stress corrosion cracking initiation.

It is a further object of the present invention to use a flowing electrolyte in order to flush out metal dissolution products during the polishing process.

Other features and objects of the present invention are stated in or apparent from a detailed description of a presently preferred embodiment of the invention found hereinbelow.

DETAILED DESCRIPTION OF THE PREFERRED EMBODIMENT

Figure 1:
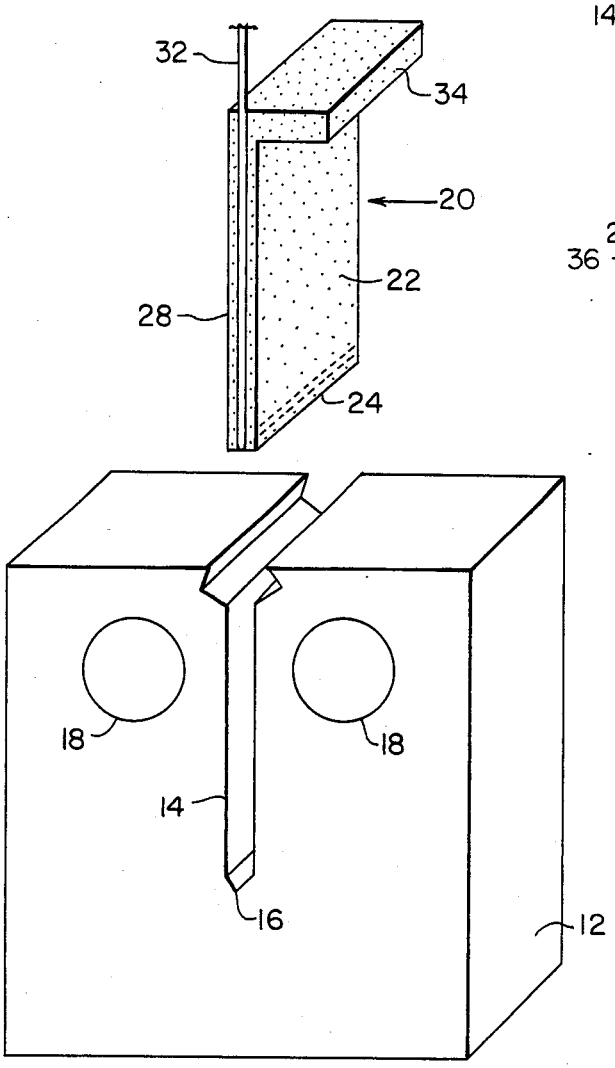
FIG. 1 is a perspective view of a test specimen and insertable electrode according to the present invention.
Figure 3:
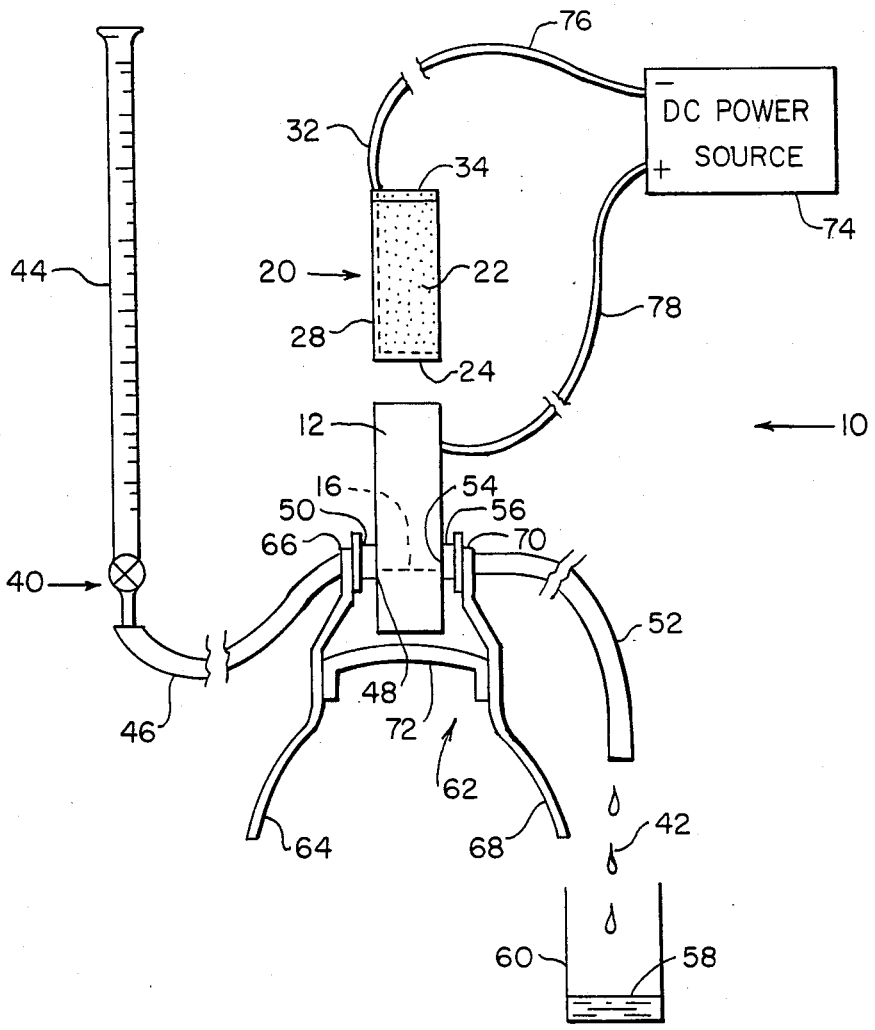
FIG. 3 is a schematic representation of the electrochemical polishing apparatus of the present invention.

With reference now to the drawings which like numerals represent like elements throughout the views, an electrochemical polishing apparatus 10 is depicted in FIG. 3 for use on a test specimen 12. Test specimen 12 is depicted in greater detail in FIG. 1 and is typical of test specimens used to measure the crack initiation properties of materials such as nickel-chromium alloy test material. Typical of the crack initiation properties tested is fatigue, corrosion fatigue, and stress corrosion cracking. As shown, test specimen 12 includes a deep notch 14 including a tip 16 where local stresses are applied. Test specimen 12 also includes two apertures or holes 18 which are used to facilitate testing of specimen 12 under a load (stress).

In the preparation of test specimen 12, the machining operation used to produce notch 14 causes a surface machining affected zone or layer on the exterior surfaces of notch 14 and-tip 16. These affected layers have induced residual stresses and distressed metal, so that the affected layer at tip 16 produces a variable and confounding effect on any test results produced using test specimen 12. It is thus the purpose of electrochemical polishing apparatus 10 to achieve a controlled uniform dissolution of the affected layer adjacent tip 16 in order to obtain test results with test specimen 12 which are more relevant to the basic test material properties rather than to the uncertain combined effects of surface manufacturing processes and the test material properties.

In order to selectively polish tip 16, an electrode device 20 is used. Electrode device 20 includes an insulated body 22 which sized to be snuggly received within notch 14. Insulated body 22 includes a distal end 24 with a groove 26 provided along the length thereof. Insulated body 22 also includes a longitudinal side 28 with a groove end 30 therein. Disposed in grooves 26 and 30 is an electrode in the form of a nichrome wire 32. In order to facilitate a reproducible locating of distal end 24 of electrode device 20 relative to tip 16, an insulated stop 34 is also provided.

Figure 2:
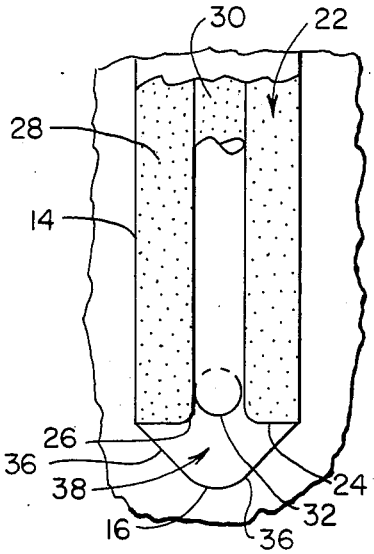
FIG. 2 is an enlarged elevation view of the tip of the notch depicted in FIG. 1 with the electrode located in the notch.

As shown in FIG. 2, insulated body 22 is inserted in notch 14 until distal end 24 of insulated body 22 contacts inclined walls 36 of tip 16 and stop 34 conducts test specimen 12. In this position, insulated body 22 seals the remainder of notch 14 from tip 16 and thus creates a lateral passage 38 along tip 16. A different spacing of distal end 24 from tip 16 is simply made by relocating the position of stop 34 on a new electrode device 20.

Electrochemical polishing apparatus 10 also includes a circulating means 40 for circulating an electrolyte 42 through passage 38. In this embodiment, circulating means 40 includes a burette 44 to which an inlet tube 46 is connected. Inlet tube 46 includes an inlet end 48 having a sealing means 50 therearound which is positioned adjacent one end of passage 38. Conveniently, inlet tube 48 is simply a rubber hose with sealing means 50 formed by doubling the end of the rubber hose back upon itself. On the other side of passage 38, an outlet tube 52 including an outlet end 54 with a sealing means 56 conducts electrolyte from passage 38 to a collection reservoir 58 contained in a beaker 60.

Preferably, inlet tube 46 and outlet tube 52 are detachably located on either end of passage 38 by a suitable holding means 62. Holding means 62 includes a first arm 64 having a distal end 66 to which inlet tube 46 is suitably attached as by passing inlet tube 46 through a suitable aperture in end 66 before rolling inlet end 48 backup on itself to form sealing means 50. Similarly, a second arm 68 is provided with a distal end 70 to which outlet tube 52 is attached. Provided between first arm 64 and second arm 68 is a resilient means 72 which normally urges distal end 66 of first arm 64 towards distal end 70 of second arm 68. Thus, by squeezing the opposite ends of arms 64 and 68 together, distal ends 66 and 70 are urged apart to allow the quick and easy positioning of test specimen 12 therebetween.

Electrochemical polishing apparatus 10 further includes a DC power source 74. The cathodic pole (−) of the DC power source 74 is suitably attached to electrode device 20 by a suitable connecting means 76 of low resistance conductor and clamp. In addition, the anodic pole (+) of the DC power source 74 is also attached to test specimen 12 by a suitable connecting means 78.

In operation, electrochemical polishing apparatus 10 is used in the following manner to provide for the selective anodic dissolution of the surface of tip 16 in notch 14 of test specimen 12. Where test specimen 12 is a nickel-chromium alloy having a length and width of approximately 1" and a depth of approximately 0.4", notch 14 typically has a width of about 0.05". With such a test specimen 12, wire 32 is a nickel-chromium alloy and electrolyte 42 contained in burette 44 is a sulfuric-nitric acid.

Initially, electrode device 20 is inserted in notch 14 to the position depicted in FIG. 2 with wire 32 adjacent tip 16 along the length of tip 16. Connecting means 78 is then suitably attached to test specimen 12. Test specimen 12 is next located between sealing means 50 and 56 by movement of distal ends 66 and 70 of arms 64 and 68 away from one another by drawing the opposite ends of arms 64 and 68 together. Once test specimen 12 is suitably positioned, distal ends 66 and 70 are allowed to come together by the action of resilient means 72 to suitably seal passage 38 by the appropriate positioning of sealing means 50 and 56.

Before turning on DC power source 74, electrolyte 42 contained in burette 44 is allowed to flow by gravity through inlet tube 46, passage 38 and outlet tube 52 by the opening of the stopcock of burette 44. The flow velocity of electrolyte 42 is in the range of 2 to 8 feet per second in the notch tip passage 38. DC power source 74 is then operated at between 1 to 3 amperes per square centimeter, with a resulting cell potential of 3 to 6 volts.

Typically, the time required to remove the machining surface affected zone of tip 16 (up to 0.005 inches) is in the range from 2 to 10 minutes.

By the operation of electrochemical polishing apparatus 10 in the above-identified manner to remove the surface layer at tip 16, the critical dimensions and test loading fixture dimensional compatibility of test specimen 12 is preserved while controlled and uniform notch surface removal takes place. It should be appreciated that this capability is facilitated by the use of wire 32 (or alternately a plastic sheath insulated thin metal strip) at distal end 24 of insulated body 22 which wire is placed in immediate proximity to the working surface. In addition, the use of an electrolyte which is sufficiently conductive and which flows rapidly through the working surface flushes out the metal dissolution products. Without discharge of the chemical reactions from the electrochemically polished metal dissolution region, the required uniformity and surface smoothness would be compromised.

Figure 4:
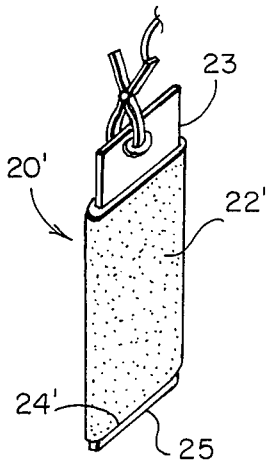
FIG. 4 is a perspective view of an alternative embodiment of an insertable electrode according to the present invention.

An alternative design for an electrode device 20' is depicted in FIG. 4. As shown, electrode device 20' includes an insulated body 22' and a conducting thin metal strip 23. Conducting strip 23 passes through insulated body 22' so as to have a protruding end surface 25 adjacent a distal end 24' of insulated body 22'. Preferably, insulated body 22' is a thin flexible/shrinkable plastic sleeve which is thus easily applied to strip 23. Conducting strip 23 is preferably nickel, a stainless grade of steel (i.e., AISI 304 stainless steel), or a nickel alloy (i.e., Alloy 600).

Although the present invention has been described with respect to an exemplary embodiment thereof, it will be understood by those of ordinary skill in the art that variations and modifications can be effected within the scope and spirit of the invention.

We claim:

1. An apparatus for the selective electrochemical polishing of a lateral tip of a deep longitudinal notch in a work piece comprising:

a DC power source;

a first connecting means for connecting said DC power source to the work piece;

a body formed of an insulating material, said body being sized to be inserted longitudinally in the notch such that a lateral distal end thereof seals the notch longitudinally and is located adjacent to the lateral tip but spaced from the lateral tip so as to provide a lateral passage between said distal end and the tip;

an electrode disposed laterally along the distal end of said body, said electrode including a second connecting means for connecting said electrode to said DC power source;

an electrolyte; and a circulating means for circulating said electrolyte through the passage such that said electrolyte only contacts the work piece adjacent said passage wherein the lateral passage includes opposite ends, and wherein said circulating means includes an inlet tube located at one end of the passage an and outlet tube at the other end of the passage.

2. An electrochemical polishing apparatus as claimed in claim 1 wherein said electrode is a wire, wherein said lateral distal end of said body includes a central groove in which a portion of said wire is located, and wherein said body further includes a longitudinal side having a central groove therein which meets with the central groove in said distal end of said body and in which a further portion of said wire is located.

3. An apparatus for the selective electrochemical polishing of a lateral tip of a deep longitudinal notch in a work piece comprising:

a DC power source;

a first connecting means for connecting said DC power source to the work piece;

a body formed of an insulating material, said body being sized to be inserted longitudinally in the notch such that a lateral distal end thereof seals the notch longitudinally and is located adjacent to the lateral tip but spaced from the lateral tip so as to provide a lateral passage between said distal end and the tip;

an electrode disposed laterally along the distal end of said body, said electrode including a second connecting means for connecting said electrode to said DC power source;

an electrolyte; and a circulating means for circulating said electrolyte through the passage such that said electrolyte only contacts the work piece adjacent said passage wherein said electrode is a wire, wherein said lateral distal end of said body includes a central groove in which a portion of said wire is located, and wherein said body further includes a longitudinal side having a central groove therein which meets with the central groove in said distal end of said body and in which a further portion of said wire is located.

4. An electrochemical polishing apparatus as claimed in claim 3 and further including an inlet seal means located at an end of said inlet tube for sealing the end of said inlet tube to the work piece about the one end of the passage, and an outlet seal means located at an end of said outlet tube for sealing the end of said outlet tube to the work piece about the other end of the passage.

5. An electrochemical polishing apparatus as claimed in claim 4 and further including a first arm having a distal end to which said inlet seal means is attached and a second arm having a distal end to which said outlet seal means is attached, and wherein said means for detachably locating said inlet tube and said means for detachably locating said outlet tube includes a resilient means located between said first arm and said second arm for resiliently urging said distal ends of said first arm and said second arm toward one another.

6. An apparatus for the selective electrochemical polishing of a lateral tip of a deep longitudinal notch in a work piece comprising:

a DC power source;

a first connecting means for connecting said DC power source to the work piece;

a body formed of an insulating material, said body being sized to be inserted longitudinally in the notch such that a lateral distal end thereof seals the notch longitudinally and is located adjacent to the lateral tip but spaced from the lateral tip so as to provide a lateral passage between said distal end and the tip;

an electrode disposed laterally along the distal end of said body, said electrode including a second connecting means for connecting said electrode to said DC power source;

an electrolyte; and a circulating means for circulating said electrolyte through the passage such that said electrolyte only contacts the work piece adjacent said passage wherein said electrode is an end surface of a thin conducting strip, and wherein said body is a sleeve of a plastic material having an open end in which said end surface of said thin conducting strip is located.

7. An apparatus for the selective electrochemical polishing of lateral tip of a deep longitudinal notch in a work piece comprising:

a DC power source;

a first connecting means for connecting said DC power source to the work piece;

a body formed of an insulating material, said body being sized to be inserted longitudinally in the notch such that a lateral distal end thereof seals the notch longitudinally and is located adjacent to the lateral tip but spaced from the lateral tip so as to provide a lateral passage between said distal end and the tip;

an electrode disposed laterally along the distal end of said body, said electrode including a second connecting means for connecting said electrode to said DC power source;

an electrolyte; and a circulating means for circulating said electrolyte through the passage such that said electrolyte only contacts the work piece adjacent said passage wherein said body is made of plastic and said electrode is a nichrome wire.

8. An electrochemical polishing apparatus as claimed in claim 7 wherein said electrolyte is a sulfuric-nitric acid for use on a nickel-chromium alloy test material.

9. A method for the selective electrochemical polishing of a lateral tip of a deep longitudinal notch in a work piece comprising the steps of:

inserting an electrode and insulated body longitudinally in the notch, said inserting step including the steps of (a) locating an electrode laterally along a distal end of the insulated body and (b) sealing the lateral distal end of the insulated body adjacent the lateral tip but spaced from the lateral tip such that a lateral passage is formed between the distal end and the tip;

circulating an electrolyte through the passage such that the electrolyte only contacts the work piece adjacent the passage; and connecting the electrode and work piece to a DC power source wherein said circulating step includes the step of feeding the electrolyte from a reservoir by gravity through the passage.

* * * * *